US007703496B2

(12) United States Patent
Fu

(10) Patent No.: US 7,703,496 B2
(45) Date of Patent: Apr. 27, 2010

(54) SAFETY CUTTING MECHANISM FOR TAPE DISPENSER

(76) Inventor: Sheng Mei Fu, 3 FL., No. 3, Alley 318, Long Chinang Rd., Taipei (TW)

( * ) Notice: Subject to any disclaimer, the term of this patent is extended or adjusted under 35 U.S.C. 154(b) by 956 days.

(21) Appl. No.: 11/476,170

(22) Filed: Jun. 28, 2006

(65) Prior Publication Data

US 2008/0000590 A1 Jan. 3, 2008

(51) Int. Cl.
*B65H 35/07* (2006.01)

(52) U.S. Cl. ..... 156/527; 156/574; 156/577; 156/579

(58) Field of Classification Search ..... 156/527, 156/574, 577, 579, 523
See application file for complete search history.

(56) References Cited

U.S. PATENT DOCUMENTS 5,393,367 A * 2/1995 Yu Chen ..... 156/523
5,928,466 A * 7/1999 Yu Chen ..... 156/527
6,491,082 B1 * 12/2002 Fu ..... 156/527
2002/0195204 A1 * 12/2002 Huang ..... 156/577
2004/0016509 A1 * 1/2004 Lissoni ..... 156/523
2007/0267455 A1 * 11/2007 Huang ..... 225/20
2008/0099151 A1 * 5/2008 Lee ..... 156/527

* cited by examiner

*Primary Examiner*—Mark A Osele
(74) *Attorney, Agent, or Firm*—Rosenberg, Klein & Lee

(57) ABSTRACT

A safety cutting mechanism for tape dispenser includes a fixing seat located above a hold-down roller of the tape dispenser, a cutter mounted in the fixing seat, and a safety cover located above the cutter. Two curved spring arms are rearward and outward extended from a rear edge center of the safety cover to provide a predetermined elasticity, and a rib is provided across a lower front edge of the safety cover to normally locate in front of and thereby shield a toothed blade of the cutter when the tape dispenser is not in use. When the tape dispenser is forward tilted to tense and press a length of dispensed adhesive tape against a desired location, the rib of the safety cover is pushed upward and rearward by the tensed adhesive tape to slide away from the cutter and expose the toothed blade for cutting the adhesive tape.

1 Claim, 6 Drawing Sheets

SAFETY CUTTING MECHANISM FOR TAPE DISPENSER

FIELD OF THE INVENTION

The present invention relates to a safety cutting mechanism for a tape dispenser, and more particularly to a safety cutting mechanism that prevents a cutter of a tape dispenser from unexpectedly injuring people when the tape dispenser is not in use.

BACKGROUND OF THE INVENTION

A general tape dispenser includes a base and a tape roll holder rotatably mounted on a front top of the base, as well as a cutter having a toothed blade and located at a lower front of the base. When a length of adhesive tape is dispensed and bonded to a desired location, the tape dispenser is usually tilted forward by a suitable angle for the cutter to cut the dispensed adhesive tape. The toothed blade of the cutter is normally exposed from the base, and tends to unexpectedly injure a user when the user tries to fetch the tape dispenser for use.

SUMMARY OF THE INVENTION

A primary object of the present invention is to provide a safety cutting mechanism for tape dispenser, so that a cutter of the tape dispenser is properly shielded to prevent the cutter from injuring a user who tries to fetch the tape dispenser for use.

To achieve the above and other objects, the safety cutting mechanism for tape dispenser according to the present invention includes a fixing seat located above a hold-down roller of the tape dispenser and defining a forward recess for receiving a cutter and a safety cover therein. The cutter has a toothed blade for cut an adhesive tape, and the safety cover is located above the cutter and has two curved spring arms symmetrically and angularly rearward and outward extended from near a rear edge center of the safety cover to provide the safety cover with a predetermined elasticity.

The safety cover is provided across a lower front edge with a downward extended rib having a predetermined height, such that when the tape dispenser is not in use or in the process of dispensing a length of adhesive tape, the rib is normally located in front of the cutter to shield the toothed blade of the cutter; and when the tape dispenser is forward tilted to tense and press the length of dispensed adhesive tape against a desired location, the rib of the safety cover is elastically pushed upward and rearward by a tension of the tensed adhesive tape to slide away from the cutter and expose the toothed blade for cutting the adhesive tape.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
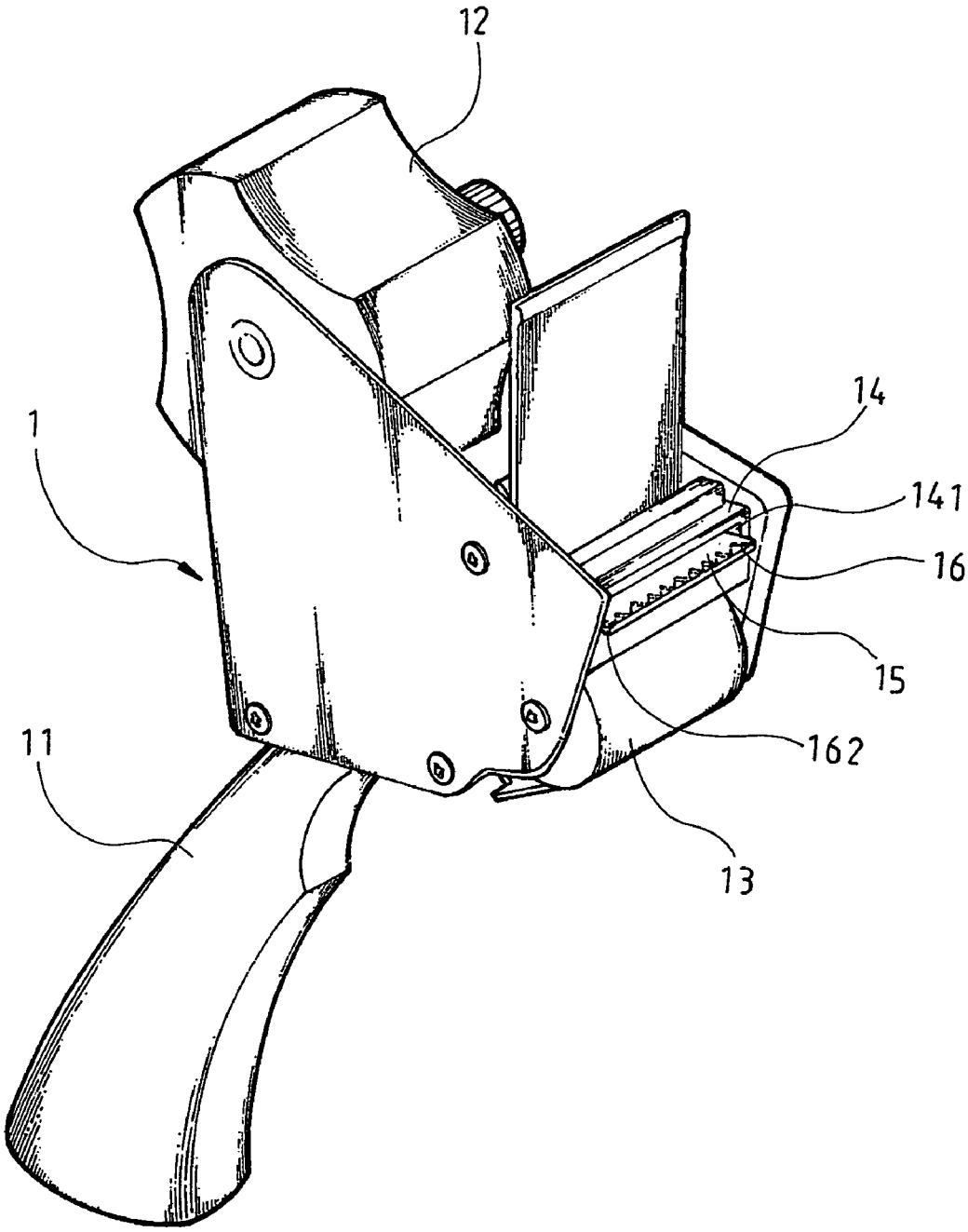
FIG. 1 is a perspective view showing a tape dispenser provided with a safety cutting mechanism according to the present invention.
Figure 2:
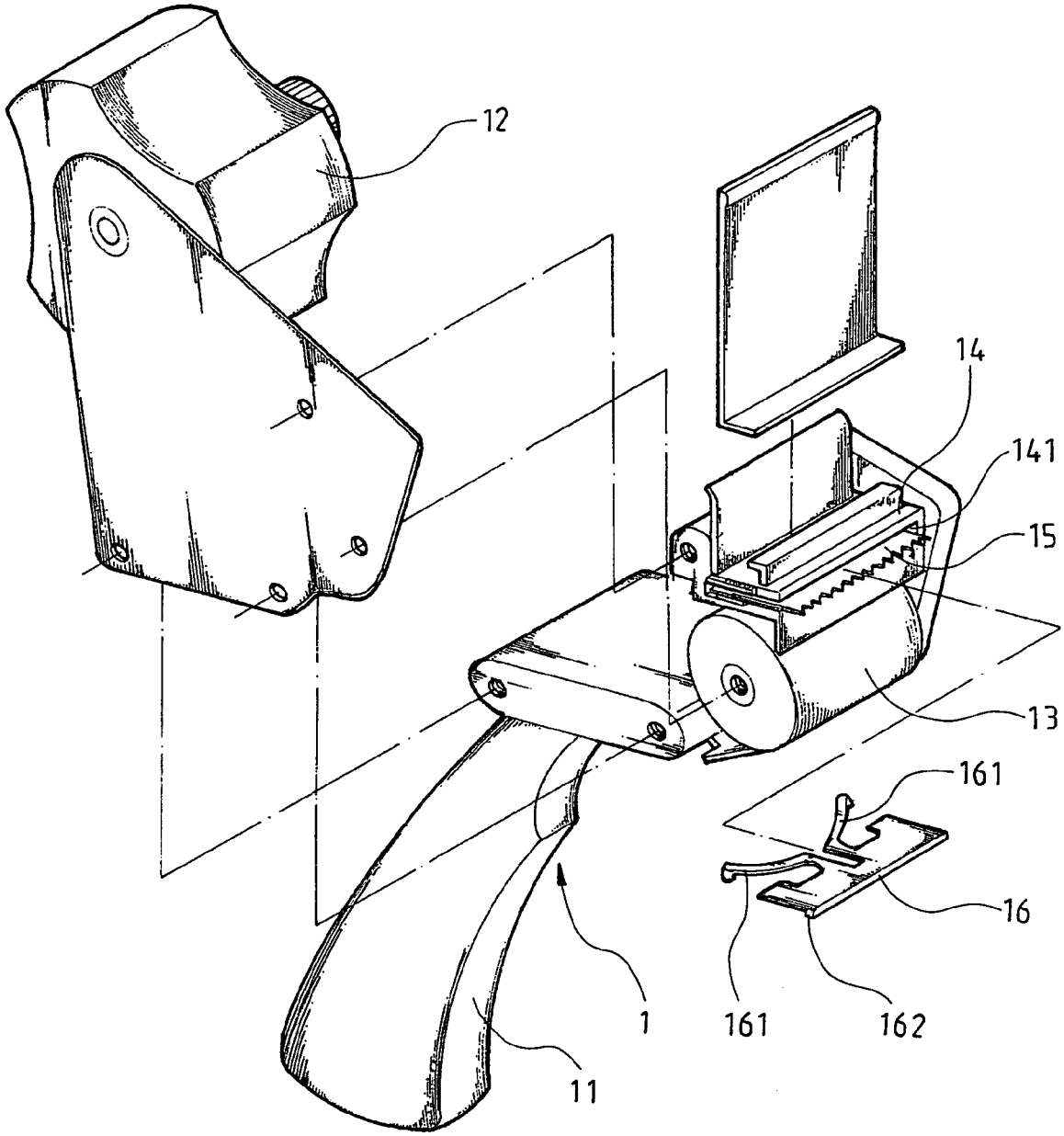
FIG. 2 is an exploded view of FIG. 1.
Figure 3:
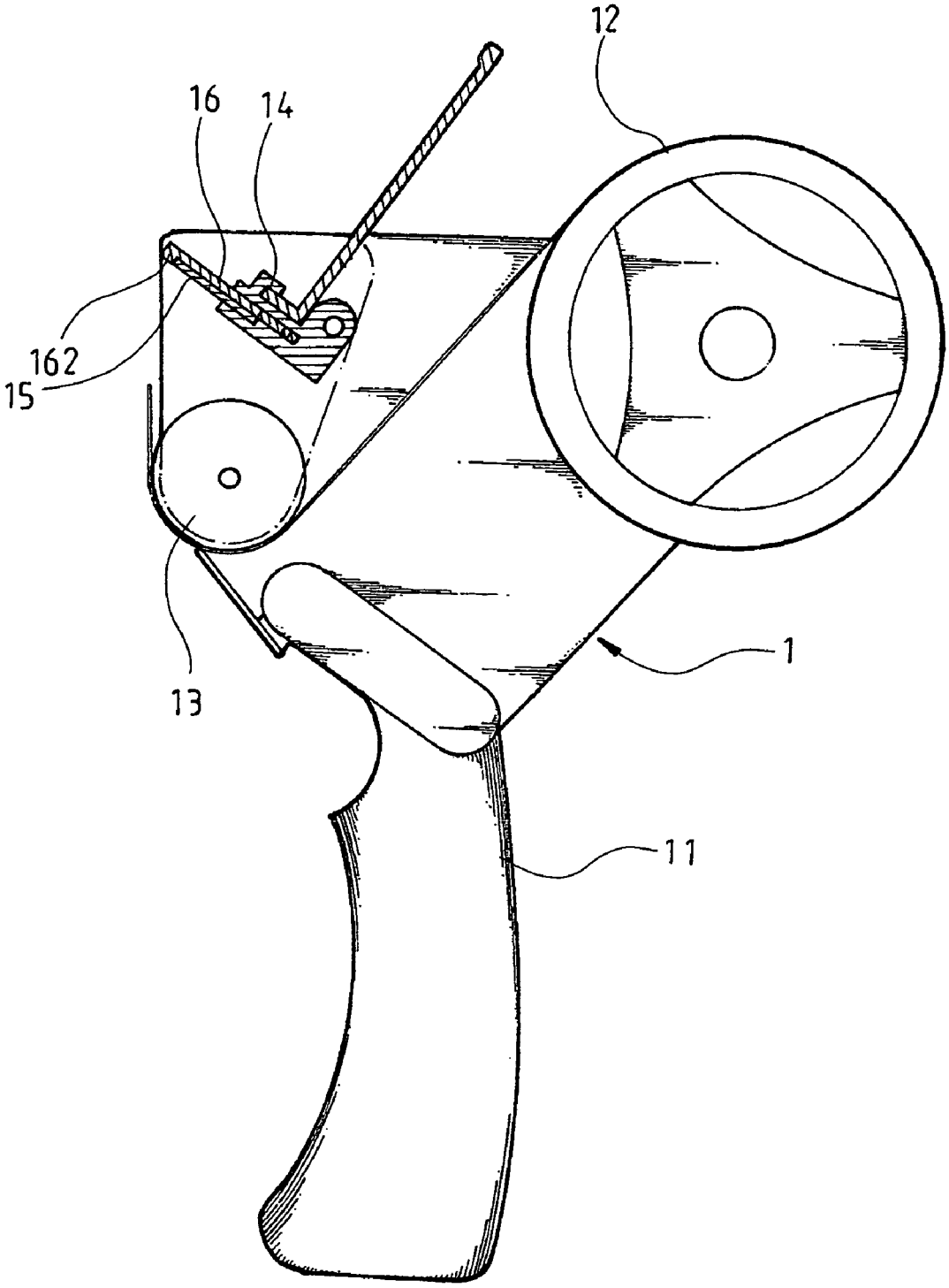
FIG. 3 is a sectioned side view showing the safety cutting mechanism for tape dispenser according to the present invention.

Please refer to FIGS. 1, 2, and 3 at the same time, in which a tape dispenser 1 provided with a safety cutting mechanism of the present invention is shown. The tape dispenser 1 includes a fixed handle 11, a rotatable tape roll holder 12 located above the handle 11, and a hold-down roller 13 located at a lower front of the tape roll holder 12. The safety cutting mechanism includes a fixing seat 14 located above the hold-down roller 13 and defining a forward recess 141 for receiving a cutter 15 and a safety cover 16 therein. The cutter 15 has a front toothed blade. The safety cover 16 is located above the cutter 15, and has two curved spring arms 161 symmetrically and angularly extended rearward and outward from near a rear edge center of the safety cover 16, such that when the safety cover 16 is located in the forward recess 141, distal ends of the two spring arms 161 are abutted on and retained to a rear inner edge of the recess 141 to hold the safety cover 16 in place in the recess 141 and provide the safety cover 16 with a predetermined elasticity. The safety cover 16 is provided across a lower front edge with a downward extended rib 162 having a predetermined height, such that the rib 162 is normally located in front of the cutter 15 to shield the toothed blade of the cutter 15.

When the tape dispenser 1 is not in use, the toothed blade of the cutter 15 is normally shielded by the rib 162 of the safety cover 16 without the risk of injuring any person nearby the tape dispenser 1. And, when a length of adhesive tape has been dispensed on a desired location using the tape dispenser 1, the tape dispenser 1 may be tilted forward for the cutter 15 to cut the dispensed adhesive tape. At this point, the dispensed adhesive tape is tensed to push the rib 162 of the safety cover 16 upward and rearward, so that the safety cover 16 elastically slides away from the cutter 15 to expose the toothed blade, allowing the cutter 15 to cut the adhesive tape.

Figure 4:
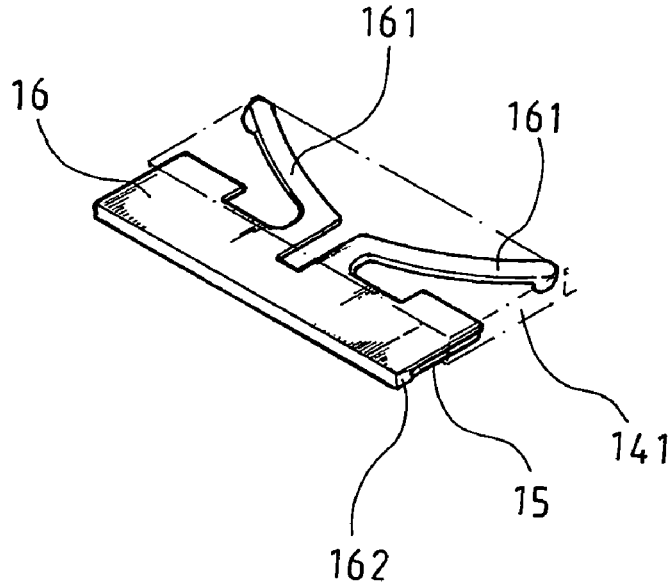
FIG. 4 is a perspective view showing a safety cover of the safety cutting mechanism of the present invention at an extended position to shield a toothed blade of a cutter.
Figure 6:
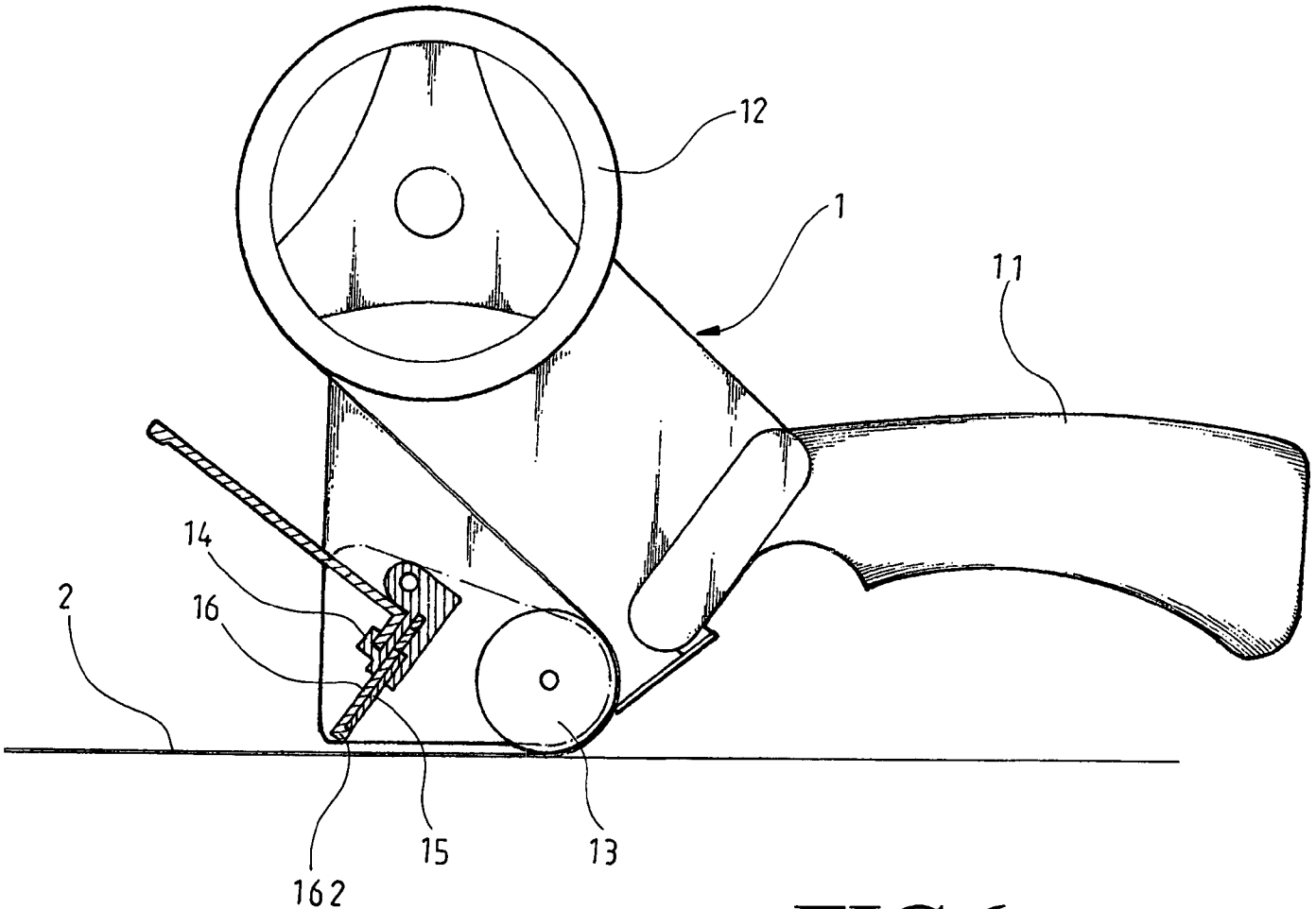
FIGS. 6 and 7 are sectioned side views showing the movement of the safety cutting mechanism of the present invention when the tape dispenser is operated to dispense and cut a length of adhesive tape.
Figure 6A:
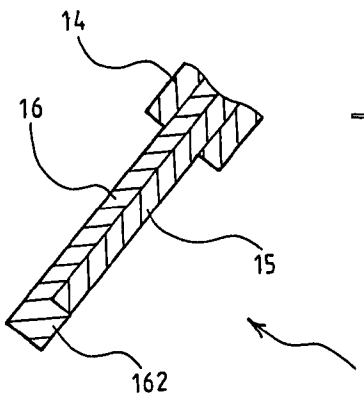
FIGS. 6A and 7A. are enlarged views of rib 162.

Please refer to FIGS. 4 and 6. When the tape dispenser 1 is not in use, or is in the process of dispensing a length of adhesive tape 2, the adhesive tape 2 is located below and pressed by the hold-down roller 13 against a desired location, and the safety cover 16 received in the fixing seat 14 is pushed forward by the spring arms 161 to an extended position for the rib 162 to shield the toothed blade of the cutter 15, preventing the cutter 15 from injuring a user.

Figure 5:
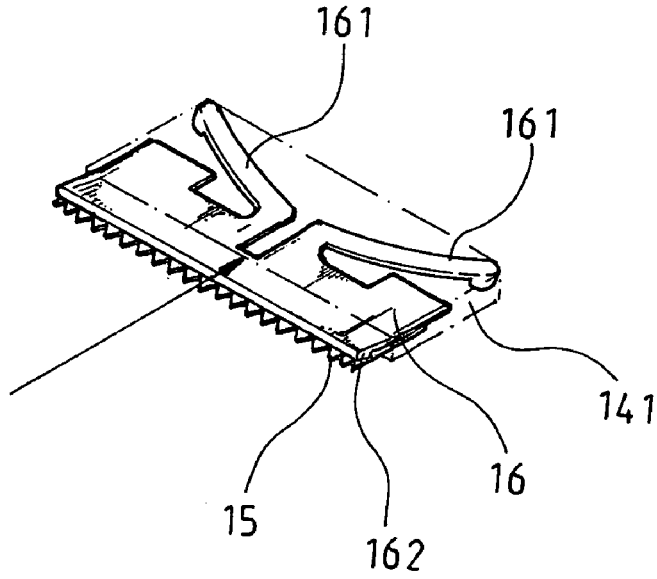
FIG. 5 is a perspective view showing the safety cover of the safety cutting mechanism of the present invention at a retracted position to expose the toothed blade of the cutter for cutting.
Figure 7:
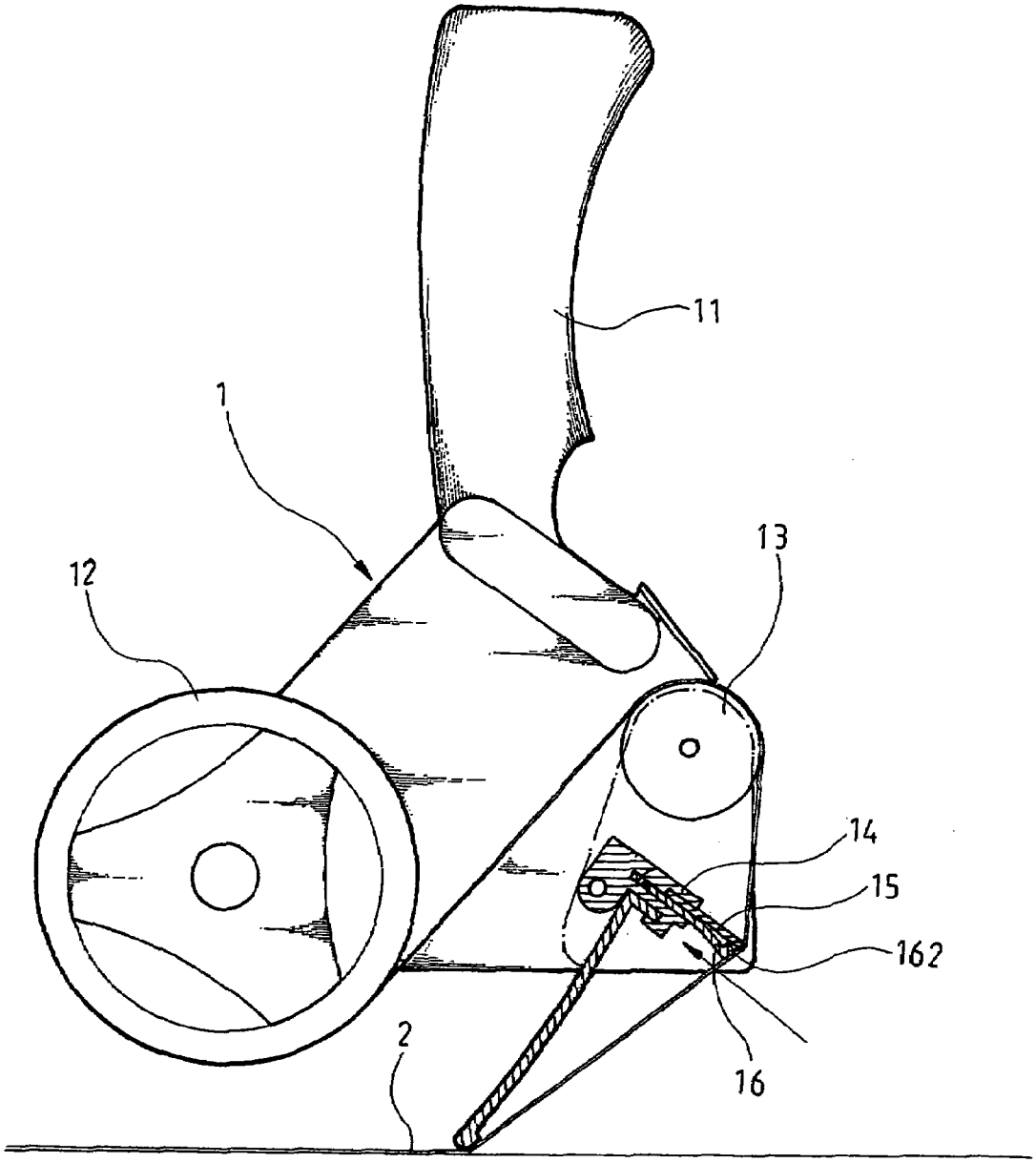
Figure 7A:
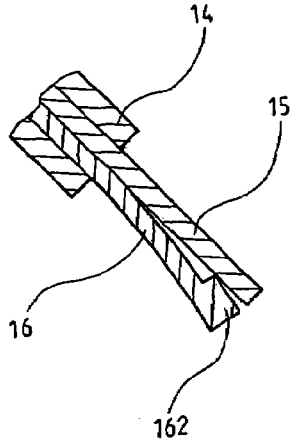

Please refer to FIGS. 5 and 7. When the dispensed adhesive tape 2 has been firmly attached to the desired location, the tape dispenser 1 is operated in a normal way to tilt forward, so that a section of the dispensed adhesive tape 2 between the desired location and the hold-down roller 13 is tensed to produce a predetermined tension and push against the rib 161 of the safety cover 16, causing the rib 161 to slide upward and backward to a retracted position to expose the toothed blade of the cutter 15. The exposed blade of the cutter then cuts the adhesive tape 2 to complete the bonding of the adhesive tape 2 to the desired location. When the adhesive tape 2 has been cut, the safety cover 16 is elastically pushed forward by the two spring arms 161 to cover the toothed blade of the cutter 15 again, preventing the cutter 15 from injuring anyone.

In brief, the safety cutting mechanism for tape dispenser according to the present invention includes a safety cover 16 that is normally elastically pushed forward by two spring arms 161 to locate a lower front rib 162 in front of a toothed blade of a cutter 15 of the tape dispenser 1, so that the cutter 15 of the tape dispenser 1 not in use or in the process of dispensing a length of adhesive tape 2 is safely covered by the safety cover 16 without the risk of injuring people.

What is claimed is:

1. A safety cutting mechanism for tape dispenser, comprising a fixing seat located above a hold-down roller of the tape dispenser and defining a forward recess for receiving a cutter and a safety cover therein; said cutter having a toothed blade for cutting an adhesive tape; said safety cover being located above said cutter and having two curved spring arms angularly rearward and outward extended from near a rear edge center of said safety cover for locking engagement in the forward recess of said fixing seat when the distal ends of said spring arms of said safety cover are abutted against a rear inner edge of said recess for retaining said safety cover in said forward recess to provide said safety cover with a predetermined elasticity; said safety cutting mechanism being characterized in that said safety cover is provided across a lower front edge with a downward extended rib having a predetermined height and extending downward from said safety cover in a substantially orthogonal direction, such that when said tape dispenser is not in use or in the process of dispensing a length of the adhesive tape, said rib is normally located in front of said cutter to shield the toothed blade of said cutter; and when said tape dispenser is forward tilted to tense and press the dispensed adhesive tape against a desired location, said rib of said safety cover is pushed upward and rearward by a tension of said tensed adhesive tape to slide away from said cutter to expose said toothed blade for cutting the adhesive tape.

* * * * *